United States Patent [19]

Ruottu et al.

[11] Patent Number: 4,918,828

[45] Date of Patent: Apr. 24, 1990

[54] METHOD AND APPARATUS FOR DRYING A MOVING WEB

[75] Inventors: Reijo Ruottu; Raimo Rajala, both of Kaarina; Ilkka Jokioinen; Sture Ahlskog, both of Lieto, all of Finland

[73] Assignee: Valmet Paper Machinery Inc., Finland

[21] Appl. No.: 261,161

[22] Filed: Oct. 21, 1988

[30] Foreign Application Priority Data

Nov. 2, 1987 [FI] Finland ..... 874805

[51] Int. Cl.[5] ..... F26B 3/28

[52] U.S. Cl. ..... 34/4; 34/156; 34/41; 34/23

[58] Field of Search ..... 34/4, 23, 41, 156; 226/97

[56] References Cited

U.S. PATENT DOCUMENTS 4,074,841 2/1978 Kramer et al. ..... 34/156 X 4,594,795 6/1986 Stephansen ..... 34/156 X

*Primary Examiner*—Henry A. Bennet

*Assistant Examiner*—John Sollecito

*Attorney, Agent, or Firm*—Steinberg & Raskin

[57] ABSTRACT

Apparatus for drying a moving web includes a first infrared dryer unit having a first infrared treatment gap, a gas-support unit situated substantially immediately after the first infrared dryer unit and having a gas-support unit gap into which web-supporting gas blowings are directed, and a second infrared dryer unit situated after the gas-support unit and having a second infrared treatment gap. The gas-support gap has a width which is less than the width of the first infrared gap and the width of the second infrared treatment gap is less than the width of the first infrared treatment gap and greater than the width of the gas-support gap. In accordance with the method, the web is passed through the first infrared treatment gap so that upon exiting from the gap, its temperature has preferably been raised only to a point where evaporation of water from the web is imminent but has not begun, whereupon the web is passed through the gas-support gap in which web-supporting gas blowings, preferably heated, are directed in regions of both sides of the web, whereupon the web is passed through the second infrared treatment gap where evaporative drying is accomplished.

20 Claims, 1 Drawing Sheet

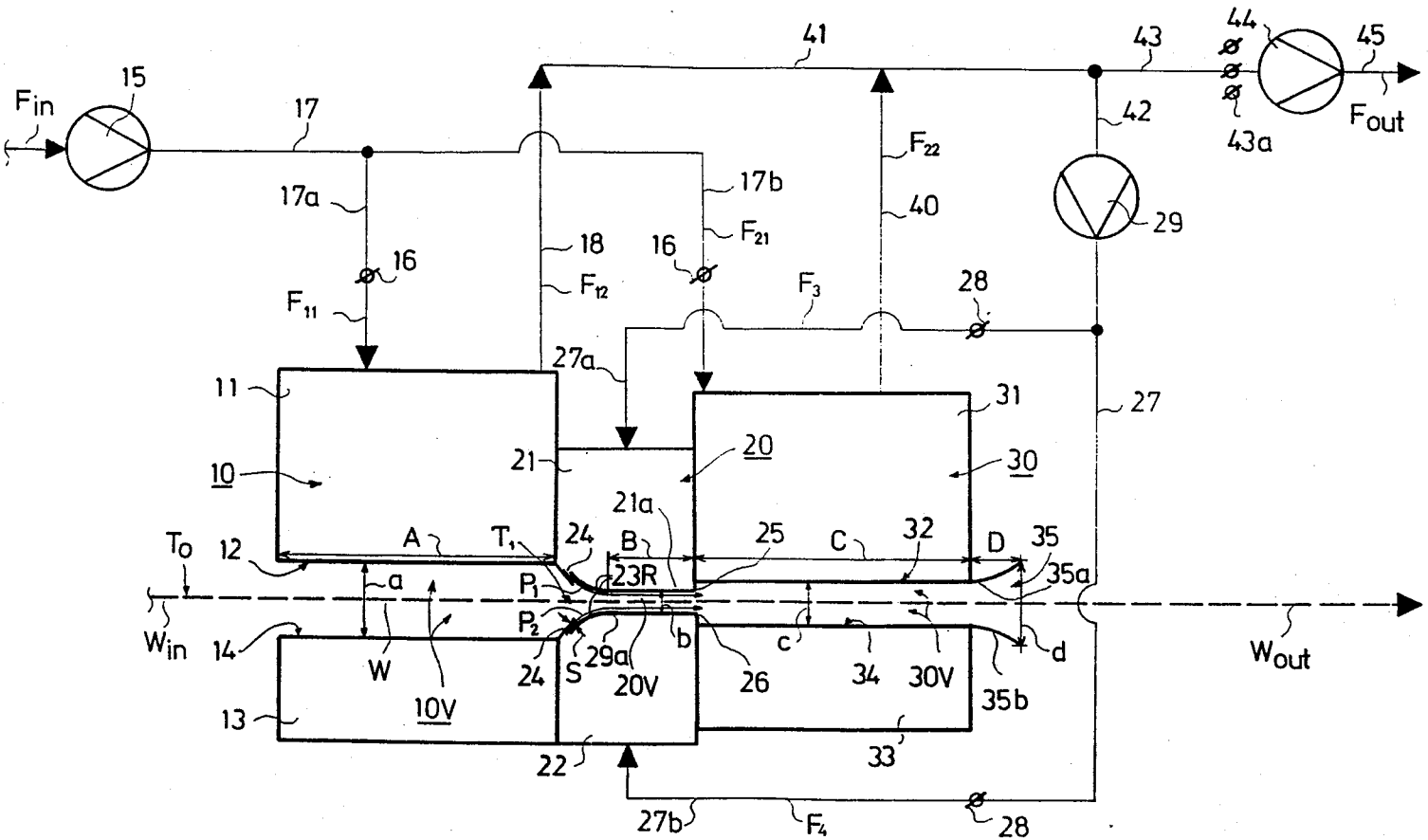
Fout
Wout
Fin
Win
To
F11
F12
F21
F22
F3
F4
T1
P1
P2
A
B
C
D
W
S
a
b
c
d

METHOD AND APPARATUS FOR DRYING A MOVING WEB

BACKGROUND OF THE INVENTION

This invention relates generally to methods and apparatus for drying moving webs and, more particularly, to methods and apparatus for drying webs comprising infrared dryer units and gas-support units in which gas blowings are directed into web support gaps so as to stabilize the run of the web.

The invention, while being useful in the drying of any type of moving web, is particularly suited to the drying of paper or board webs. For example, a typical application of the invention is in the drying of paper webs in connection with coating or surface-sizing.

Paper webs are conventionally coated either by means of separate coating devices or by means of on-machine devices which are integrated into the paper machines themselves, or by means of surface-sizing devices which operate in the drying section of a paper machine. In the latter case, the web to be coated is passed from the end of a multi-cylinder drying section to a coating device whereupon the web is passed to an intermediate dryer and then to an after-dryer consisting, for example, of a group of drying cylinders. A typical application of the invention is for use as such an intermediate dryer, although it is understood that the invention has applicability in many other environments.

Airborne web dryers are also known in which paper and board webs or the like are dried in a contact free manner. Such airborne web dryers are used, for example, after blade, roll or spread-type paper coating devices to dry the wet coating in a contact free manner.

Conventional airborne web dryers in common use operate using jets or blowings of gas, usually air. This contributes to the fact that conventional airborne web dryers are rather long pieces of equipment that require a large amount of space since the distance over which the air blowings act on the web must be relatively long to provide sufficient drying capacity. Another reason that air-borne web dryers require substantial space is that the density of energy consumed which is useful in drying is relatively low.

Other types of dryers useful in drying moving webs are based on radiation effects, such as infrared radiation dryers. Drying by infrared radiation is advantageous in that infrared radiation has a relatively high energy density which increases as the wavelength of the radiation decreases. However, the use of infrared dryers in drying paper webs has been hampered, for example, by the risk that fire may result as the wavelength of the radiation is decreased and the temperature increases.

Airborne web dryers can essentially be divided into two categories depending upon the type and arrangement of the blow nozzles through which the drying and web-supporting gas, usually air, is directed. The blow nozzles can be essentially divided into two groups, namely, positive-pressure or float nozzles and negative-pressure or foil nozzles.

On the other hand, it is desired to improve conventional infrared dryers by providing contact-free support of the web as it passes through the drying or treatment gap while eliminating or reducing fluttering of the web.

SUMMARY OF THE INVENTION

It is an object of the present invention to provide new and improved methods and apparatus for drying moving webs.

Another object of the present invention is to provide new and improved methods and apparatus for drying moving webs utilizing infrared drying.

Still another object of the present invention is to provide new and improved methods and apparatus for drying moving webs utilizing infrared drying and wherein the web is supported in a contact-free manner during the drying whereby the web will under no circumstances contact the extremely hot surfaces that define the drying gap.

A further object of the present invention is to provide new and improved methods and apparatus for drying moving webs, including multiple infrared dryers and a gas-support system wherein the web will pass through the infrared dryers safely and without fluttering, even where breakage should occur within the drying apparatus.

A still further, though non-essential, object of the present invention is to provide new and improved methods and apparatus for drying moving webs including an infrared dryer having a relatively high specific evaporating output and where it is possible to utilize air for cooling the infrared radiators in connection with the drying of the web so that convection is utilized in the drying of the web.

Yet another object of the present invention, although not essential thereto, is to provide new and improved methods and apparatus for drying moving webs using an infrared heater and wherein the dried web departs from the infrared dryer in a stable fashion without fluttering.

Briefly, in accordance ,with the present invention, these and other objects are obtained by providing in the direction of running of the web, a first infrared dryer unit having a relatively wide treatment gap, a gas-support unit situated substantially immediately after the first infrared dryer and having a relatively narrow gas-support gap into which web-supporting gas blowings are directed in the regions of both sides of the web, and a second infrared dryer unit situated after the gas-support unit having a second infrared treatment gap, the width of which is less than the width of the first infrared treatment gap and greater than the width of the gas-support gap of the preceeding gas-support unit.

It is the second infrared dryer unit that functions as the evaporative drying unit. The web is heated in the first infrared dryer unit so that upon exiting the gap, its temperature has preferably been raised only to a point where evaporation of water from the web is substantially imminent but has not as yet begun, so that substantially all of the evaporative drying occurs in the second infrared dryer unit.

The invention also comprises infrared drying apparatus comprising one or more infrared treatment gaps as well as one or more gas-support units and wherein a diffuser unit is provided at the outlet side of an infrared treatment gap, preferably the last such treatment gap, in the infrared dryer. The diffuser unit functions to stabilize the run of the web in a manner such that it leaves the dryer apparatus without fluttering.

DESCRIPTION OF THE DRAWINGS

A more complete appreciation of the present invention and many of the attendant advantages thereof will be readily understood by reference to the following detailed description when considered in connection with the accompanying drawing which is a schematic illustration of apparatus for drying a moving web in accordance with the invention and to which the invention is in no way confined.

DESCRIPTION OF THE PREFERRED EMBODIMENT

Referring now to the drawing, an embodiment of apparatus in accordance with the invention for drying a moving web W, such as a paper or board web after surface-sizing or coating the same is illustrated. The web entering the apparatus is designated $W_{in}$ and the web departing from the apparatus is designated $W_{out}$.

The dryer apparatus comprises two infrared dryer units 10 and 30 situated one after the other and a gas-support unit situated between the infrared dryer units. The first infrared dryer unit 10 in the direction of the run of the web comprises an infrared radiator unit 11 having a plane radiation window 12 facing the web W and a reflector unit 13 having a plane reflector surface 14 parallel to and facing the radiation window. With this construction, the infrared radiation is reflected from the reflector surface 14 of the reflector unit 13 back onto the web W in the first treatment gap 10V. The infrared radiators preferably comprise electrically heated elements although it is understood that other conventional designs, such as gas heated elements, may be used.

Several separate radiation elements situated in side by side fashion are preferably used in both the first infrared dryer unit 10 as well as in the second infrared dryer unit 30. The radiation output of the separate radiation elements can be separately adjusted so that in this manner it is possible to control the transverse moisture profile of the web W.

The gas-support unit 20 is situated substantially immediately after the first infrared dryer unit and comprises a blow box 21 extending over the entire width of the web W and a corresponding blow blox 22 situated on the opposite side of the web W. Blow boxes 21 and 22 are provided with nozzle slots 24 at the inlet side of the web W, each slot being formed by a curved Coanda surface 23R.

The Coanda surfaces guide web-supporting gas (air) blowings $P_1$ and $P_2$ from nozzle slots 24 of boxes 21 and 22 to the web W obliquely towards the web whereupon they attain a direction substantially parallel to the web in the region of the gas-support gap 20V defined by a pair of opposed substantially planar surface portions **21*a* and 22*a* of the respective blow boxes which form extensions of Coanda surfaces 23R**.

The gas-support unit 20 is immediately followed by second infrared dryer unit 30 whose construction is, in principle, similar to that of the first infrared dryer unit 10. The second infrared dryer unit 30 comprises an infrared radiator unit 31 having a plane radiation window 32 and a reflector unit 33 including a plane reflector face 34 situated opposite and parallel to the radiation window 32 of radiator 31 and separated from it by the treatment gap 30V. Infrared radiation is applied in the treatment gap 30V for drying the web W through the radiation window 32.

The second infrared dryer unit 30 is followed by a diffuser unit 35 defined by curved diffuser plates **35*a* and 35*b* which diverge away from the plane of web W after the treatment gap 30V. The diffuser unit 35 acts to prevent fluttering of the web W after it departs from the treatment gap 30V. The curvature of the diffuser plates 35*a* and 35*b* is preferably such that the cross-sectional area of the diffuser in a plane perpendicular to the web W between the plates 35*a* and 35*b*** is substantially the same as in a conical diffuser having a cone angle in the range of between about 5° to 10°, and preferably about 8°.

In accordance with one aspect of the invention, a stepwise widening gap portion defined by stepped members 25 and 26 follow the gas-support gap 20V. The stepped gap portion has a width that widens in a stepwise fashion from a width equal to that of the gas support gap 20V to a width equal to that of the wider treatment gap 30V of the second infrared dryer unit 30. The stepped gap portion in one embodiment advantageously widens about 5 mm. By means of the stepped gap portion defined by stepped members 25 and 26, any problems in the running quality of the web that may be caused by the gas-support gap 20V are eliminated. Moreover, the stepped gap portion also serves in part to produce turbulence in the second treatment gap 30V which intensifies the evaporation drying which occurs in the second infrared treatment gap 30V.

A particularly advantageous system for circulating gas in accordance with the invention will now be described. Air is the gas typically utilized. The air required for cooling the infrared dryers 10 and 30 as well as for the web-supporting gas blowings $P_1$ and $P_2$ is supplied to the system at $F_{in}$ by means of a blower 15 through a duct 17. The duct 17 divides into a pair of ducts **17*a* and 17*b*, each of which is provided with a flow regulator 16. The cooling air flows $F_{11}$ and $F_{21}$ flow through the ducts 17*a* and 17*b* for cooling the infrared units 10 and 30. The cooling air is of course heated during the cooling operation and is then directed through ducts 18 and 40 as air flows $F_{12}$ and $F_{22}$ and pass into duct 41 which communicates with duct 42 at the suction side of a blower 29 as well as with a duct 43 at the suction side of an exhaust blower 44. A flow regulator 43*a* is provided in duct 43 to adjust the amount of exhaust air flow Fout passing from the system through duct 45 at the pressure side of blower 44. The air which is heated during the cooling of the infrared units 10 and 30 is passed through the duct 27 at the pressure side of blower 29 into the blow boxes 21 and 22 of the gas-support unit 20 to thereby constitute the air for the web-supporting gas blowings $P_1$ and $P_2$. Thus, the duct 27 is divided into ducts 27*a* and 27*b* provided with flow adjustors 28** by means of which the intensity of the gas blowings $P_1$ and $P_2$ can be adjusted.

The length A of the radiator unit in the first infrared treatment gap 10V of the first infrared dryer unit 10 is preferably within the range of between about 400 to 550 mm. The length C of the radiator unit 31 in the second infrared treatment gap 30V of the second infrared dryer unit 30 is approximately the same as the length A. The length in the machine direction of the respective opposed reflector units 13 and 33 is somewhat larger, for example, about 50 mm. larger than the lengths A and C of the radiator units 11 and 31 of the infrared dryer units 10 and 30. The length B in the machine direction of the opposed, substantially planar surface portions **21*a*** and 22*a* of the gas-support nozzles 24 is preferably on the order of about 100 mm.

In accordance with another aspect of the invention, the first infrared dryer unit 10 operates so that no substantial amount of evaporation occurs as the web moves through the gap 10V. Rather, the radiation energy applied to the web in gap 10V is preferably used mainly for heating the web W just to the evaporation temperature of the water present in the web W. If it is assumed that the inlet temperature $T_0$ of the web W prior to entering gap 10V is in the range of between about 30° to 40° C., the temperature $T_1$ of the web W departing from the gap 10V of the first infrared dryer unit 10 and at the entrance to the gas support unit 20 should preferably be in the range of between about 60° to 70° C. The radiation output in the first infrared dryer unit 10 and the dimensions of gap 10V can be regulated to obtain this operation.

In one embodiment which operates in the manner described above, the width a of the first infrared treatment gap 10V is in the range of between about 40 to 60 mm, preferably about 50 mm. The width b of the gas-support gap 20V is preferably in the range of between about 12 to 25 mm. and the width c of the second infrared treatment gap 30V in which evaporation drying of the web occurs is in the range of between about 20 to 50 mm., preferably about 30 mm.

The curvature of the diffuser plates 35*a* and 35*b* of diffuser 35 is recited above. The length D in the machine direction of diffuser 35 is preferably in the range of between about 80 to 150 mm. while the transverse width d of the mouth of the diffuser is preferably in the range of between about 20 to 60 mm. The width s of the nozzle slots 24 is preferably in the range of between about 3 to 5 mm. The velocity Y of the web supporting gas blowings $P_1$ and $P_2$ is preferably about 1.5 times the running speed of the web W. By means of the difference between the velocity of the gas blowings $P_1$, $P_2$ and the velocity of the moving web W, it is possible to obtain an optimal running quality for the web while at the same time ensuring that the web W will not contact the hot surfaces defining the second infrared treatment gap 30V in the second infrared dryer unit 30, even in cases where the web breaks during transport through the dryer apparatus. As noted above, the height of the stepped members 25 and 26 in the transverse direction is preferably about 5 mm. which has been found to create sufficient turbulence to intensify evaporative drying in the drying gap 30V.

When the length B of the planar carrying surfaces of the gas-support gap 20V is relatively short, it is possible to maintain the width b of the gas-support gap 20V at a minimum without risking contact between the web and stationary parts of the gas-support unit 20.

The objects of the invention are achieved in part through appropriate selection of the length dimensions A, B, C and width dimensions a, b, and c and of their respective ratios. Suitable relationships between those dimensions are:

(1) $A=C$;
(2) $2B<A<6B$;
(3) $a>c>b$;
(4) $2<a/b<5$; and
(5) $1.5<a/c<3$.

The most appropriate values of the dimensions are, generally, in the mid-regions of the above ranges.

When a diffuser 35 is utilized in apparatus in accordance with the invention after the second infrared dryer unit 30, it is possible to provide a considerable level of turbulence in the evaporation drying gap 30V while the web W nevertheless departs from the infrared dryer in a stable fashion without fluttering due to the diffuser 35.

After passing through the infrared drying apparatus of the invention, the web W may be passed either directly into other processing apparatus, or into an additional separate airborne web dryer wherein the drying of the web is continued or completed. If a separate airborne web drying apparatus is employed, it is preferable to integrate the infrared dryer of the invention substantially directly with the following airborne web dryer so that a diffuser 35 is not required.

It will be understood that even though the web W is shown in the illustrated embodiment as running through the dryer apparatus in a substantially horizontal plane, the invention can also be carried out with the web W running vertically, either upwardly or downwardly, or in an inclined fashion.

When a gas-support system is suitably dimensioned and situated between a pair of infrared dryer units, and where the lengths in the machine direction and widths of the treatments gaps are dimensioned and appropriately proportioned to each other as described above, and when, if necessary or desirable, the apparatus is provided with a diffuser unit at its outlet side and a suitable air circulation system, a novel and efficient infrared dryer apparatus is obtained which can be dimensioned for a number of different webs as well as for different applications.

Obviously, numerous modifications and variations of the present invention are possible in the light of the above teachings. Therefore, it is to be understood that within the scope of the claims appended hereto, the invention may be practiced otherwise than as specifically disclosed herein.

What is claimed is:

1. Apparatus for drying a moving web comprising, in the direction of run of the web, a first infrared dryer unit having a first infrared treatment gap through which the web runs, said first infrared treatment gap having a width;

a gas-support unit situated substantially immediately after said first infrared dryer unit having a gas-support gap through which the web runs and into which web-supporting gas blowings are directed on both sides of the web, said gas-support gap having a width less than said width of said first infrared treatment gap; and a second infrared dryer unit situated after said gas-support unit having a second infrared treatment gap through which the web runs, said second infrared treatment gap having a width less than said width of said first infrared treatment gap and greater than said width of said gas-support gap of said gas-support unit.

2. Apparatus in accordance with claim 1 wherein said second infrared dryer unit operates as an evaporation-drying unit.

3. Apparatus in accordance with claim 1 wherein said gas support unit comprises a pair of opposed substantially planar surface portions defining said gas-support gap between them, and nozzle means for directing said web-supporting gas blowings over said planar surface portions to produce a negative pressure.

4. Apparatus in accordance with claim 3 wherein said first and second infrared treatment gaps have respective lengths and wherein said lengths of said first and second infrared treatment gaps are each substantially greater than the length of said planar surface portions of said gas-support unit.

5. Apparatus in accordance with claim 4 wherein said lengths of said first and second infrared treatment gaps are substantially equal to each other.

6. Apparatus in accordance with claim 5 wherein each of said lengths of said first and second infrared treatment gaps are in the range of between about 2 to 6 times the length of said planar surface portions of said gas-support unit.

7. Apparatus in accordance with claim 1 wherein a stepwise widening gap portion follows said gas-support gap, said widening gap portion having a width that widens in a stepped fashion from said width of said gas-support gap to said width of said second infrared treatment gap.

8. Apparatus in accordance with claim 7 wherein said stepwise widening gap portion comprises means for creating turbulence in said second infrared treatment gap to promote evaporative drying of the web as it runs therethrough.

9. Apparatus in accordance with accordance 8 wherein said width of said stepwise widening gap portion widens about 5 mm.

10. Apparatus in accordance with claim 1, wherein said gas-support unit is situated substantially immediately rearwardly of said first infrared dryer unit and substantially immediately forwardly of said second infrared dryer unit, and wherein said gas-support unit comprises a pair of opposed, substantially planar surface portions defining said gas-support gap, and Coanda nozzle means including curved Coanda surface portions for directing said web-supporting gas blowings over said substantially planar surface portions which form substantial extensions of said curved Coanda surface portions.

11. Apparatus in accordance with claim 10 wherein a stepwise widening gap portion follows said gas-support gap, and wherein said curved Coanda surface portions direct said web-supporting gas blowings over said substantially planar surface portions whereupon said gas blowings flow through said stepwise widening gap portion and into said second infrared treatment gap.

12. Apparatus in accordance with claim 1 wherein said first infrared dryer unit includes means for applying infrared radiation of a certain intensity onto the web running through said first infrared treatment gap, and wherein said intensity of said infrared radiation and the length and width of said first infrared treatment gap are such that the temperature of a web entering said first infrared treatment gap increases to a temperature at departure from said gap where evaporation of water from the web is imminent but has not substantially begun.

13. Apparatus in accordance with claim 12 wherein the temperature of a web entering said first infrared treatment gap at an initial temperature in the range of between about 30° to 40° C. increases to a temperature in the range of between about 60° to 70° C. as the web leaves said first infrared treatment gap.

14. Apparatus in accordance with claim 1 further including, means for supplying cooling air to said first and second infrared dryer units for cooling the same whereby said cooling air is heated;

means for supplying said heated air to said gas-support unit for use as said web-supporting gas blowings, whereby a substantial portion of thermal energy of said infrared dryer units is returned to said web for drying the same.

15. Apparatus in accordance with claim 1 further including a diffuser unit arranged at an outlet side of said second infrared treatment gap for stabilizing the run of the web and to substantially eliminate fluttering of the web as it leaves said second infrared treatment gap.

16. Apparatus in accordance with claim 15 wherein said diffuser unit comprises a pair of curved diffuser plates situated in opposed relationship to each other, said plates having a curvature such that a cross-sectional area of the diffuser increases in the flow direction in a manner corresponding to a conical diffuser having a cone angle in the range of between about 5° to 12°.

17. Apparatus in accordance with claim 16 wherein the cross-sectional area of the diffuser increases in the flow direction in a manner corresponding to a conical diffuser having a cone angle of about 8°.

18. A method for drying a moving web comprising the steps of:

passing the web through a first infrared treatment gap of a first infrared dryer unit; and then passing the web through a gas-support gap of a gas-support unit into which web-supporting gas blowings are directed on both sides of the web, said gas-support gap having a width less than the width of said first infrared treatment gap; and then passing the web through a second infrared treatment gap of a second infrared dryer unit, said second infrared treatment gap having a width less than the width of said first infrared treatment gap and greater than said width of said gas-support gap of said gas-support unit.

19. A method in accordance with claim 18 including the step of heating the web in the first infrared dryer unit so that upon departure therefrom, the web is substantially at an evaporation temperature of liquid contained therein but such that no evaporative drying occurs in said first infrared dryer unit, and carrying out evaporative drying of said web in said second infrared treatment gap.

20. A method in accordance with claim 18 including the further step of passing cooling air to said first and second infrared dryer units whereupon the cooling air is heated, and then passing said heated air to said gas-support unit for being directed as said web-supporting gas blowings.

* * * * *